US006793470B2

(12) United States Patent
Song et al.

(10) Patent No.: US 6,793,470 B2
(45) Date of Patent: Sep. 21, 2004

(54) SPRING SUPPORTING STRUCTURE FOR RECIPROCATING COMPRESSOR

(75) Inventors: Gye-Young Song, Gwangmyoung (KR); Jeong-woo Kim, Gwangmyoung (KR); Seong-Joo Han, Seoul (KR)

(73) Assignee: LG Electronics, Seoul (KR)

( * ) Notice: Subject to any disclaimer, the term of this patent is extended or adjusted under 35 U.S.C. 154(b) by 0 days.

(21) Appl. No.: 10/296,324

(22) PCT Filed: May 24, 2001

(86) PCT No.: PCT/KR01/00868

§ 371 (c)(1),
(2), (4) Date: Nov. 22, 2002

(87) PCT Pub. No.: WO02/079649

PCT Pub. Date: Oct. 10, 2002

(65) Prior Publication Data

US 2003/0170128 A1 Sep. 11, 2003

(30) Foreign Application Priority Data

Mar. 28, 2001 (KR) ..... 2001-16227

(51) Int. Cl.[7] ..... F04B 17/04; F01B 9/00
(52) U.S. Cl. ..... 417/417; 92/130 D; 92/130 C
(58) Field of Search ..... 417/417, 363; 92/130 D, 130 C, 131

(56) References Cited

U.S. PATENT DOCUMENTS 133,952 A * 12/1872 Quirk ..... 267/4
1,372,943 A * 3/1921 Constantinesco ..... 417/330
1,970,963 A * 8/1934 Hose ..... 251/14
3,788,778 A * 1/1974 Miller ..... 417/417
3,813,192 A 5/1974 Adams
4,027,211 A * 5/1977 Omura et al. ..... 318/127
6,089,836 A * 7/2000 Seo ..... 417/417
6,413,057 B1 * 7/2002 Hong et al. ..... 417/416

FOREIGN PATENT DOCUMENTS

JP 2001-73942 * 3/2001 ..... F04B/35/04

* cited by examiner

*Primary Examiner*—Justine R. Yu
*Assistant Examiner*—Timothy P. Solak
(74) *Attorney, Agent, or Firm*—Birch, Stewart, Kolasch & Birch, LLP

(57) ABSTRACT

A spring support structure for reciprocating compressor having a frame unit elastically supported inside a closed container; a reciprocating motor fixed at the frame unit; a compression unit having a piston combined to an armature of the reciprocating motor and a cylinder to be fixed at the frame unit; and a spring unit supporting a spring support provided at the armature or the piston and guiding a reciprocal movement of the piston. The spring unit includes a plurality of front springs supporting one side of the spring support in parallel and a plurality of the rear springs supporting the other side of the spring support. Because the front and rear springs elastically supporting both the armature and the piston are arranged in parallel to overlap with each other for a certain range, the horizontal length of the spring is reduced, resulting in a compact compressor.

12 Claims, 10 Drawing Sheets

II-II SECTION

III–III SECTION

SPRING SUPPORTING STRUCTURE FOR RECIPROCATING COMPRESSOR

This application is the national phase under 35 U.S.C. §371 of PCT International Application No. PCT/KR01/00868 which has an International filing date of May 24, 2001, which designated the United States of America.

TECHNICAL FIELD

The present invention relates to a spring support structure of a reciprocating compressor, and more particularly, to a spring support structure of a reciprocating compressor for elastically supporting an armature of a reciprocating motor.

Generally, a reciprocating compressor is to suck, compress and discharge a gas while a piston makes a reciprocal movement within a cylinder.

FIG. 1 is a vertical-sectional view of a reciprocating compressor of a conventional art.

As shown in FIG. 1, the conventional reciprocating compressor includes a closed container 10 in which a suction pipe (SP) and a discharge pipe (DP) communicate to each other, a reciprocating motor 20 fixed inside the closed container 10, a compression unit 30 installed in the closed container 10 and sucking, compressing and discharging a gas, a frame unit 40 supporting the reciprocating motor 20 and the compression unit 30, and a spring unit 50 elastically supporting the armature of the reciprocating motor 20 in a movement direction and inducing a resonance.

The reciprocating motor 20 includes a stator 21 consisting of an inner stator 21A and an outer stator 21B and an armature 22 inserted in an air-gap between the inner stator 21A and the outer stator 21B and making a reciprocal movement along with a piston 31 (to be described).

The compression unit 30 includes the piston 31 making a reciprocal movement by being combined to a magnet support member 22A of the reciprocating motor 20, a cylinder 32 fixed at a front frame 41 so that the piston 31 is slidably inserted thereto, and forming a compressive space along with the piston 31, a suction valve 33 mounted at the front end of the piston 31, opening and closing a gas hole 31*b* of the piston 31 to limit suction of a gas, and a discharge valve assembly 34 mounted at the front end face of the cylinder 32 to cover the compressive space and limit discharging of a compressed gas.

The frame unit 40 includes a front frame 41 supportedly contacting the front side of the inner stator 21A and the outer stator 21B, with which the cylinder 32 is insertedly combined, a middle frame 42 supportedly contacting the rear side of the outer stator 21B, and a rear frame 43 combined with the middle frame 42 to support the rear side of a rear spring 52 (to be described).

The spring unit 50 includes a front spring 51, both ends of which are supported at the front face of a combining portion of the armature 22 and the piston 31 and its corresponding inner face of the front frame 41, so as to be inserted into the outer circumference of the cylinder 32, and a rear spring 52, both ends of which are supported at a rear face of the combining portion of the armature 22 and the piston 31 and its corresponding front face of the rear frame 43.

The operation of the conventional reciprocating compressor constructed as described above will now be explained.

When a power is applied to the outer stator 21B of the reciprocating motor 20 and a flux is formed between the inner stator 21A and the outer stator 21B, the armature 22 positioned at an air gap between the inner stator 21A and the outer stator 21B is moved in the flux direction to continuously make a reciprocal movement by virtue of the spring unit 50, and accordingly, the piston 31 combined with the armature 22 makes a reciprocal movement within the cylinder 32, so that the volume of the compressive space is changed and a coolant gas is sucked into the compressive space, compressed therein and discharged therefrom.

In the sucking stroke of the piston, the coolant gas is sucked into the closed container 10 through the suction pipe (SP), passes through a gas flow passage 31*a* and the gas hole 31*b* of the piston 31 and opens the suction valve 33 so as to be sucked into the compressive space, and, in a compression stroke of the piston, the gas is compressed to a predetermined pressure and then discharged through the discharge pipe (DP) by opening the discharge valve assembly 34. The series of processes are repeatedly performed.

However, the conventional reciprocating compressor has a problem. That is, as the front spring 51 and the rear spring 52 are arranged in a straight line with the armature 22 therebetween, as shown in FIG. 2, the horizontal directional length (L) of the spring should be equivalent to at least the sum of the length (L1) of the front spring 51 and the length (L2) of the rear spring, causing a problem that the horizontal length of the compressor is lengthened.

In addition, the front spring 51 and the rear spring 52 are both compressive coil springs, which has a property of being deflected in the radial direction while being staggered in the winding direction when it is compressedly tensed. Thus, when the armature 22 and the piston 31 are making a reciprocal movement, they are vibrated in the radial direction due to the characteristics of front spring 51 and the rear spring 52 supporting them, resulting in that a general reliability of the compressor is degraded.

DISCLOSURE OF THE INVENTION

Therefore, an object of the present invention is to provide a spring support structure of a reciprocating compressor that is capable of reducing a horizontal length of a compressor.

Another object of the present invention is to provide a spring support structure of a reciprocating compressor that is capable of reducing a vibration in the radial direction due to a coil spring elastically supporting an armature and a piston of a compressor and improving a stability of the compressor.

To achieve these and other advantages and in accordance with the purpose of the present invention, as embodied and broadly described herein, there is provided a spring support structure of a reciprocating compressor having a frame unit elastically supported inside a closed container; a reciprocating motor fixed at the frame unit; a compression unit having a piston combined to an armature of the reciprocating motor and a cylinder into which the piston is slidably-inserted to be fixed at the frame unit; and a spring unit supporting a spring support provided at the armature or the piston and guiding a reciprocal movement of the piston, wherein the spring unit includes a plurality of front springs supporting one side of the spring support in parallel and a plurality of the rear springs supporting the other side of the spring support.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

MODE FOR CARRYING OUT THE PREFERRED EMBODIMENTS

Reference will now be made in detail to the preferred embodiments of the present invention, examples of which are illustrated in the accompanying drawings.

Figure 1:
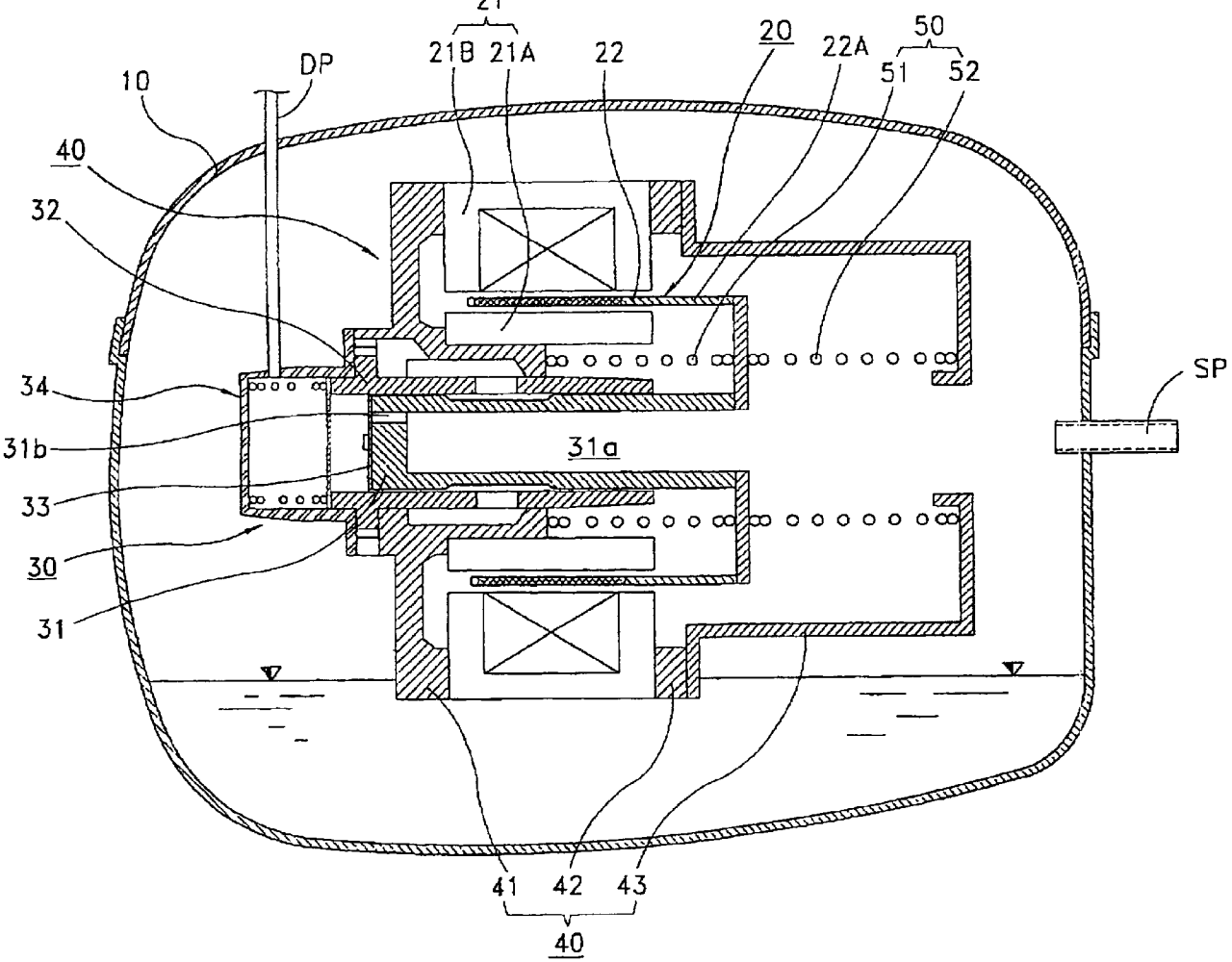
FIG. 1 BACKGROUND ART
FIG. 1 is a vertical-sectional view of a reciprocating compressor in accordance with a conventional art.
Figure 2:
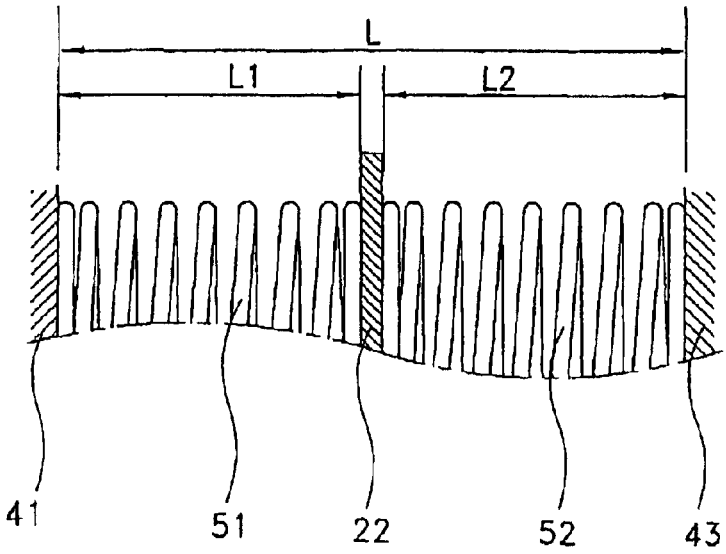
FIG. 2 BACKGROUND ART
FIG. 2 is a schematic view showing the total length of a spring of the reciprocating compressor in accordance with the conventional art.
Figure 3:
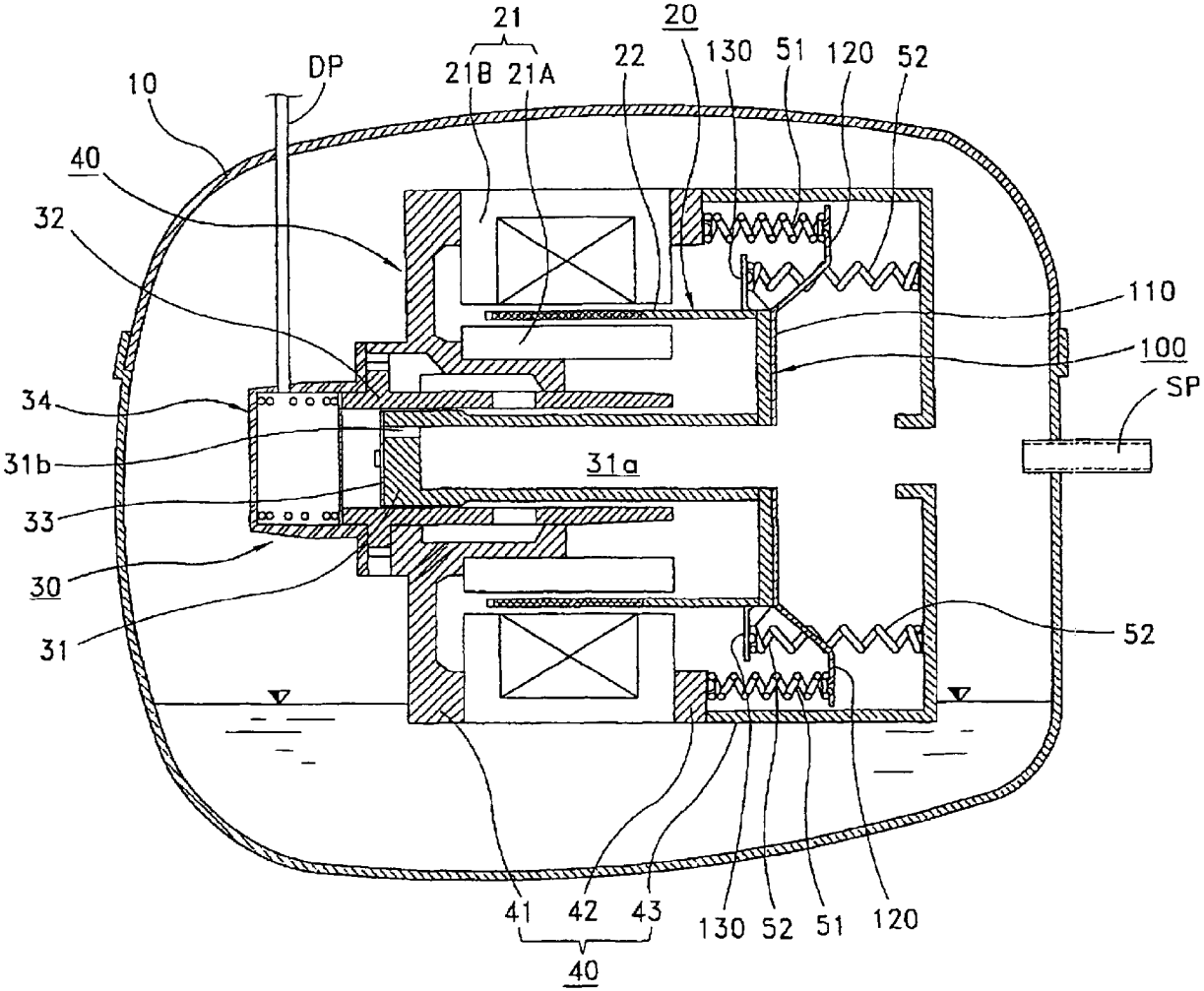
FIG. 3 is a vertical-sectional view showing an example of a reciprocating compressor in accordance with a preferred embodiment of the present invention.
Figure 4:
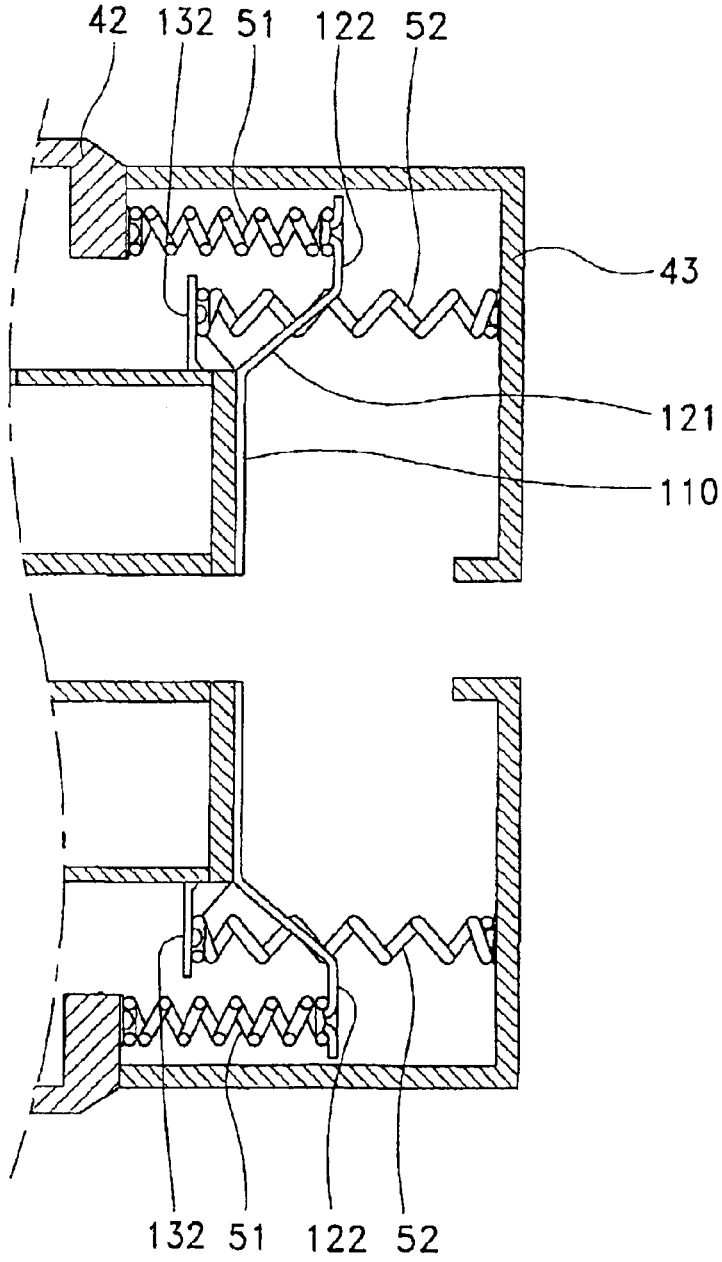
FIG. 4 is a vertical-sectional view showing a state of supporting by a spring in the reciprocating compressor in accordance with the preferred embodiment of the present invention.

FIG. 3 is a vertical-sectional view showing an example of a reciprocating compressor in accordance with a preferred embodiment of the present invention, and FIG. 4 is a vertical-sectional view showing a state of supporting by a spring in the reciprocating compressor in accordance with the preferred embodiment of the present invention.

As shown in FIGS. 3 and 4 a spring support structure of a reciprocating compressor of the present invention includes a spring support 100 fixed at a combining portion (not shown) between an armature 22 of a reciprocating motor 20 and a piston 31 combined to the armature 22 so as to make a reciprocal movement together with the armature 22, front springs 51 and rear springs 52 respectively supported at both sides of the spring support 100 and guiding a reciprocal movement of the armature 22 and the piston 31.

The spring support 100 includes a support body 110 fixed to the combing portion, front supports 120 integrally formed with the support body 110 to support the front springs 51 in parallel and rear supports 130 integrally formed with the support body together with the front supports 120 and supporting the rear springs 52 in parallel.

Figure 5:
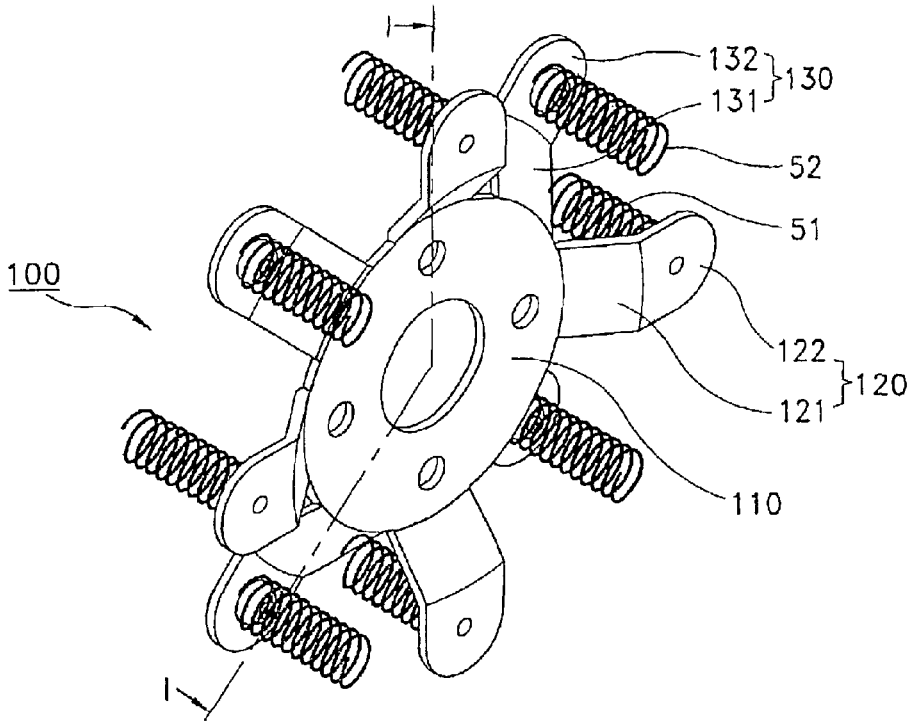
FIG. 5 is a perspective view showing an example of spring supports of the reciprocating compressor in accordance with the preferred embodiment of the present invention.

FIG. 5 is a perspective view showing an example of spring supports of the reciprocating compressor in accordance with the preferred embodiment of the present invention.

As shown in FIG. 5, the front supports 120 and the rear supports 130 are opened in both directions on the basis of a vertical central line of the plane in which support body 110 lies, of which support combined with one side of the front springs 51 becomes the front supports 120 and supports combined with one side of the rear springs 52 becomes the rear supports 130.

A plurality of the front supports 120 and the rear supports 130 (four ones) are formed at equal intervals, facing each other on the basis of the central axis of the support body 110.

Figure 6:
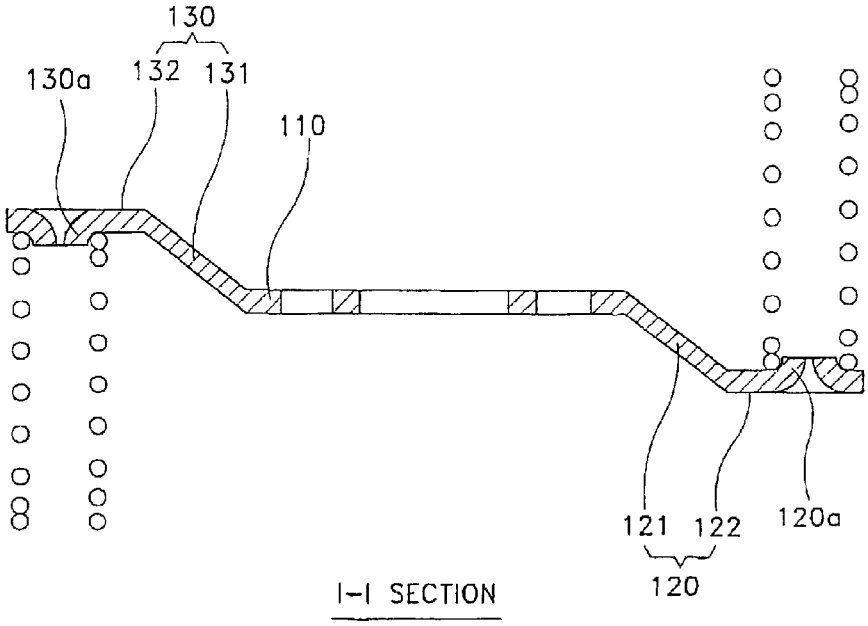
FIG. 6 is a sectional view taken along line 'I—I' of FIG. 5 in accordance with the preferred embodiment of the present invention.

FIG. 6 is a sectional view taken along line 'I—I' of FIG. 5 in accordance with the preferred embodiment of the present invention.

As shown in FIG. 6, when viewed from each side, the front supports 120 and the rear supports 130 includes slope face portions 121 and 131 bent at about 45° on the basis of a vertical central line of the plane in which the support body 110 lies and vertical portions 122 and 132 bent again at the slope face portions 121 and 131. In this case, however, supports 120 and 130 may be formed to have a horizontal portion (not shown) and a vertical portion (not shown) without such a slope face portion.

Figure 7:
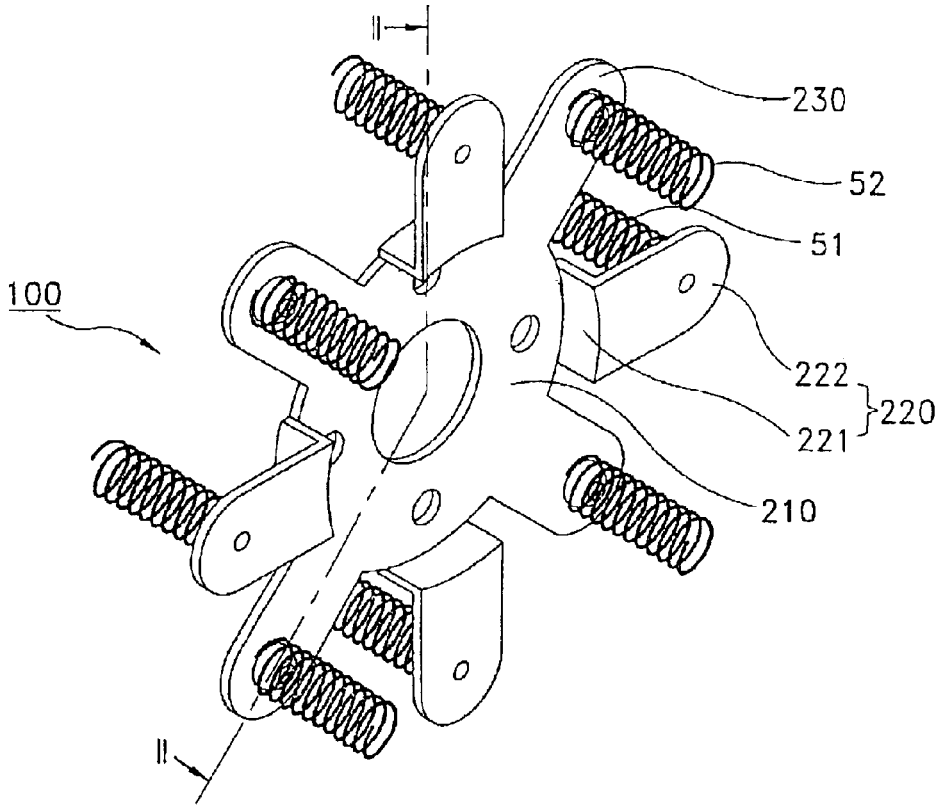
FIG. 7 is a modification of the spring support of the reciprocating compressor in accordance with the preferred embodiment of the present invention.
Figure 8:
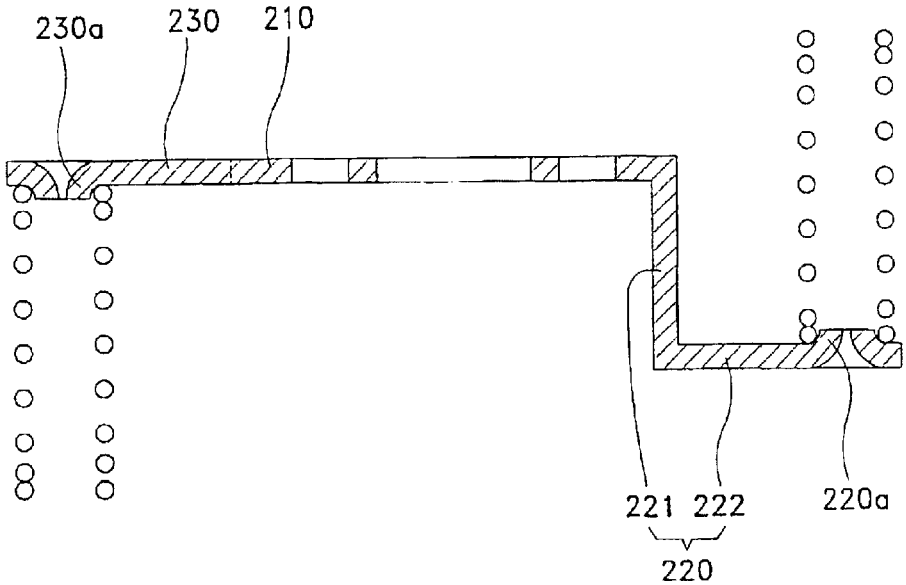
FIG. 8 is a sectional view taken along line 'II—II' of FIG. 7 in accordance with the preferred embodiment of the present invention.

FIG. 7 is a modification of the spring support of the reciprocating compressor in accordance with the preferred embodiment of the present invention, and FIG. 8 is a sectional view taken along line 'II—II' of FIG. 7 in accordance with the preferred embodiment of the present invention.

As shown in FIGS. 7 and 8, rear supports 230 are arranged in the same vertical line as that of the support body 210, while front supports 220 may be formed including a vertical portion 221 bent perpendicularly in the backward direction and a horizontal portion 222 bent again perpendicularly from the vertical portion 221.

Or, conversely, the front supports 220 may be arranged in the same vertical line as that of the support body 210, while the rear supports 230 may be formed bent perpendicularly.

The both cases are proposed in consideration of an installation space of the springs 51 and 52. Thus, if a space for installing the springs 51 and 52 are sufficient, one of the supports 220 and 230 can be bent slope.

It is preferred to form fixing protrusions 120*a*, 220*a*, 130*a* and 230*a* at each support face of the front supports 120 and 220 and the rear supports 130 and 230, to press-fit and fix one ends of the front springs 51 and the rear springs 52.

The front springs 51 and the rear springs 52 are all compressive coil springs. The other ends of the front springs 51 are tightly supported by the front frame 51 or the middle frame 42 of the frame unit 40 where the reciprocating motor 20 is fixed, and the other ends of the rear springs 52 are tightly supported by the inner face of the rear frame 43 combined with the rear side of the reciprocating motor 20.

Figure 9:
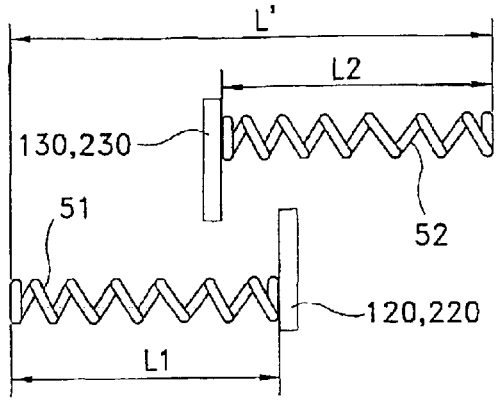
FIG. 9 is a schematic view showing the total length of a spring of the reciprocating compressor in accordance with the preferred embodiment of the present invention.

FIG. 9 is a schematic view showing the total length of a spring of the reciprocating compressor in accordance with the preferred embodiment of the present invention.

As shown in FIG. 9, one end of the front springs 51 fixed to the front supports 120 and 220 and one end of the rear springs 52 fixed at the rear supports 130 and 230 are arranged to overlap with each other within a predetermined range as the front supports 120 and 220 and the rear supports 130 and 230 are bent toward the opposite side to each other.

Figure 10:
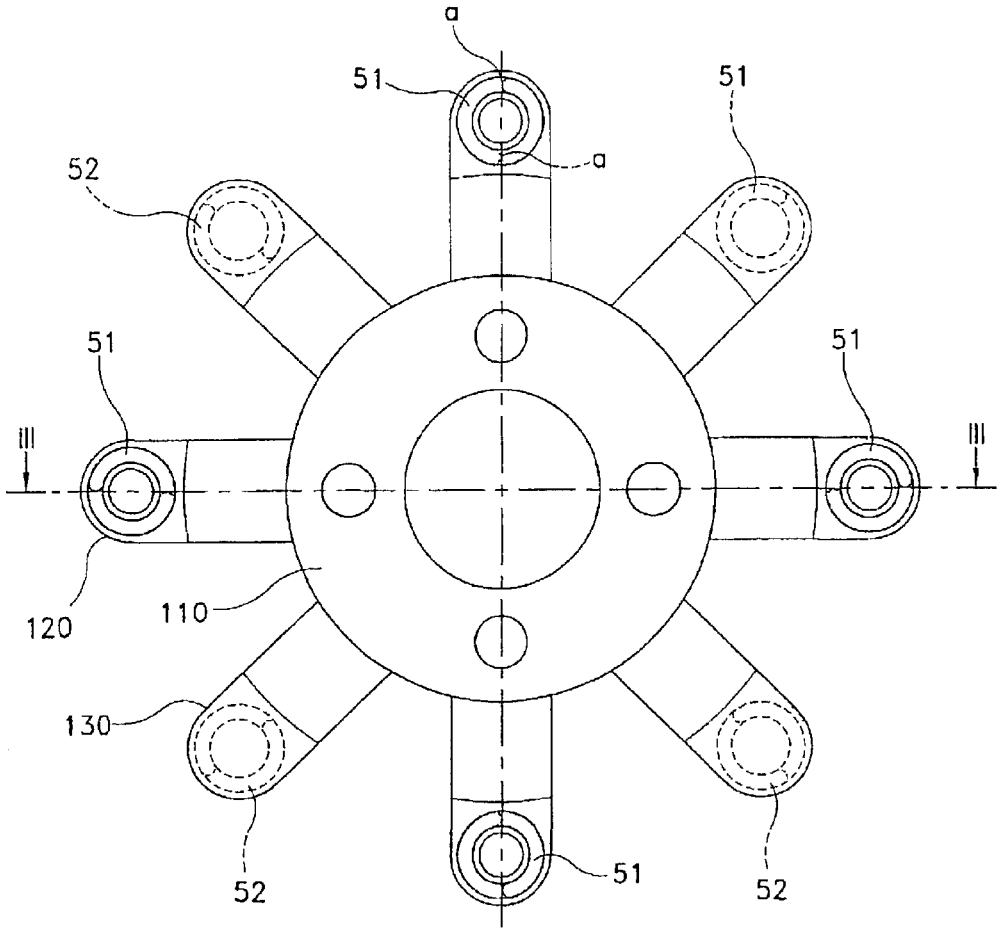
FIG. 10 is a plan view showing a mutual combination of the spring support and the spring of the reciprocating compressor in accordance with the preferred embodiment of the present invention.
Figure 11:
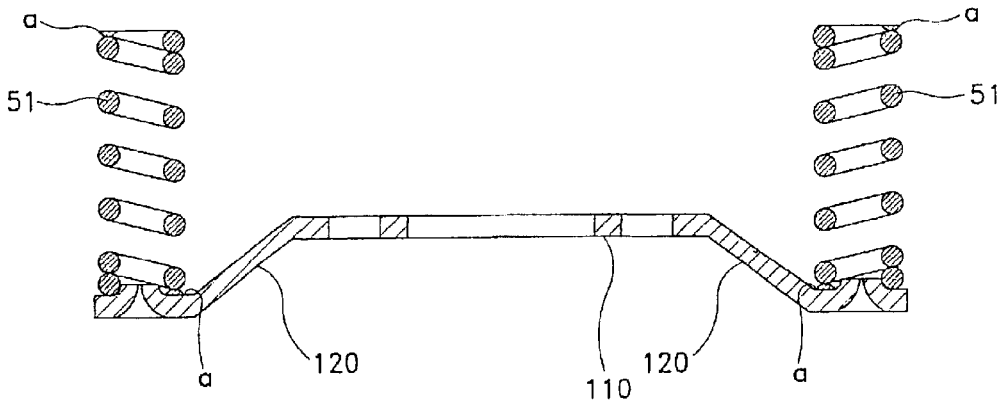
FIG. 11 is a sectional view taken along line 'III—III' of FIG. 10 in accordance with the preferred embodiment of the present invention.

FIG. 10 is a plain view showing a mutual combination of the spring support and the spring of the reciprocating compressor in accordance with the preferred embodiment of the present invention, and FIG. 11 is a sectional view taken along line 'III—III' of FIG. 10 in accordance with the preferred embodiment of the present invention.

As shown in FIGS. 10 and 11, it is preferred that the ends (a) of each spring line of springs 51 and 52 are arranged symmetrical to be directed to the central axis of the support body 110.

The same elements as those of the conventional art are given the same reference numerals.

A reference numeral 10 denotes a closed container, 21A and 21B denote an inner stator and an outer stator, 30 denotes a compression unit, 32 denotes a cylinder, 33 denotes a suction valve, 34 denotes a discharge valve assembly, SP denotes a suction pipe, and DP denotes a discharge pipe.

The general operation of the reciprocating compressor of the present invention is the same as that of the conventional art.

That is, when a power is applied to the reciprocating motor 20 and a flux is formed at the stator 21, the armature 22 is moved in the direction of the flux along with the piston 31 to make a reciprocal movement linearly by virtue of the spring unit 50. At this time, as the piston 31 makes a reciprocal movement inside the cylinder 32, a pressure difference is made in the compressive space of the cylinder 32. Owing to the pressure difference, a coolant gas is sucked into the compressive space of the cylinder 32 through the gas flow passage 31*a* of the piston 31, compressed and discharged. The series of processes are performed repeatedly.

At this time, the front springs 51 and the rear springs 52 are alternately arranged and the rear end of the front spring 51 is arranged to overlap with the front end of the rear spring 52, so that the length (L') from the front end of the front spring 51 to the rear end of the rear spring 52 is shorter than the length according to the sum of the length (L1) of the front spring 51 and the length (L2) of the rear spring 52. Thus, the horizontal length of the compressor is reduced to a compact size.

In addition, the front springs 51 and the rear springs 52 are arranged at equal intervals and the ends (a) of the spring lines of the springs 51 and 52 are arranged symmetrical to be directed to the central axis of the support body 110, so that when springs 51 and 52 are compressedly tensed, tendencies that the springs are deflected to a side and vibrated in the radial direction are offset each other, and thus, the armature 22 and the piston 31 can be stably moved reciprocally. Moreover, since abrasion made between the springs 51 and 52, the spring support 100 and the frame unit 40 as the springs 51 and 52 are rotated can be restrained, the reliability of the compressor can be improved.

As so far described, the spring support structure of the reciprocating compressor has many advantages.

That is, for example, since the front springs and the rear springs elasitcally supporting both the armature and the piston are arranged in parallel to overlap with each other for a certain range, the horizontal length of the spring is reduced, resulting in that the compressor can be compact.

In addition, since the several spring lines are arranged symmetrical, the deflection occurring due to the characteristics of the coil spring is offset to reduce the vibration of the compressor in the radial direction as well as to prevent the spring support which is relatively hard from abrading. As a result, the reliability of the compressor can be improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A spring support structure of a reciprocating compressor having a frame unit elastically supported inside a closed container; a reciprocating motor fixed at the frame unit; a compression unit having a piston combined to an armature of the reciprocating motor and a cylinder into which the piston is slidably inserted to be fixed at the frame unit; and a spring unit supporting a spring support provided at the armature or the piston and guiding a reciprocal movement of the piston, wherein the spring unit includes a plurality of front springs supporting one side of the spring support in parallel and a plurality of the rear springs supporting the other side of the spring support, a plurality of front supports integrally formed with a support body to support the front spring, and a plurality of rear supports independent from the front support and integrally formed with the support body to support the rear spring.

2. The structure of claim 1, wherein the front springs and the rear springs are arranged symmetrical to each other with reference to a central axis of the spring support.

3. The structure of claim 1, wherein each spring line of the front springs and the rear springs comprise ends that are arranged symmetrical to each other with respect to a central axis of the spring support.

4. The structure of claim 3, wherein ends of the front springs and the rear springs are arranged to be directed toward the central axis.

5. The structure of claim 1, wherein the spring support comprises:

a support body fixed at the armature or the piston.

6. The structure of claim 5, wherein the front support is located within the length of the rear spring on the basis of a vertical central line of the plane in which the the length of the front spring on the basis of the vertical central line.

7. The structure of claim 5, wherein the front support and the rear support are formed symmetrically with respect to a vertical central line of the plane in which the support body lies.

8. The structure of claim 5, wherein one of the front support and the rear support is located in the same vertical central line of the plane in which the support body lies, and the other is formed bent to have a certain interval from the vertical central line of the plane in which the support body lies.

9. The structure of claim 8, wherein when one of the front support and the rear support is formed bent, it is bent perpendicularly to the plane in which the support body lies.

10. The structure of claim 1, wherein the front support and the rear support are formed bent to have a certain slope face on the basis of the vertical central line of the plane in which the support body lies.

11. The structure of claim 1, wherein the front spring and the rear spring are arranged to have a range in which they overlap with each other.

12. A spring support structure of a reciprocating compressor having a frame unit elastically supported inside a closed container; a reciprocating motor fixed at the frame unit; a compression unit having a piston combined to an armature of the reciprocating motor and a cylinder into which the piston is slidably inserted to be, fixed at the frame unit; and a spring unit supporting a spring support provided at the armature or the piston and guiding a reciprocal movement of the piston, wherein the spring unit includes a plurality of front springs supporting one side of the spring support in parallel and a plurality of the rear springs supporting the other side of the spring support, and wherein the spring support comprises a support body fixed at the armature or the piston, a front support integrally formed with the support body to support the front spring, and a rear support integrally formed with the support body to support the rear spring, and wherein, the front support and the rear support are formed symmetrically with respect to a vertical central line of the plane in which the support body lies, and wherein the front support and the rear support are formed bent to have a certain slope face on the basis of the vertical central line of the plane in which the support body lies.

* * * * *